US009976836B1

(12) United States Patent
Thompson

(10) Patent No.: US 9,976,836 B1
(45) Date of Patent: May 22, 2018

(54) DISPOSABLE BROAD HEAD ARROWHEAD

(71) Applicant: Cold Steel, Inc., Ventura, CA (US)

(72) Inventor: Lynn Thompson, Ventura, CA (US)

(73) Assignee: COLD STEEL, INC., Ventura, CA (US)

( * ) Notice: Subject to any disclaimer, the term of this patent is extended or adjusted under 35 U.S.C. 154(b) by 0 days. days.

(21) Appl. No.: 15/348,138

(22) Filed: Nov. 10, 2016

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/582, 583, 578
See application file for complete search history.

(56) References Cited

U.S. PATENT DOCUMENTS 2,816,765 A * 12/1957 Stockfleth ..... F42B 6/08 473/583
2,816,766 A * 12/1957 Stockfleth ..... F42B 6/08 473/584
2,820,637 A * 1/1958 La Foud ..... F42B 6/08 473/583
3,398,960 A * 8/1968 Carroll, Jr. ..... F42B 6/08 473/584
4,234,191 A * 11/1980 Erlandson ..... F42B 6/08 473/583
4,529,208 A * 7/1985 Simo ..... F42B 6/08 473/584
4,621,817 A * 11/1986 Musacchia ..... F42B 6/08 403/86
4,988,112 A * 1/1991 Anderson ..... F42B 6/08 473/585
D314,416 S * 2/1991 Rezmer ..... F42B 6/08 D22/115
5,137,282 A * 8/1992 Segar ..... F42B 6/08 473/583
5,390,936 A * 2/1995 Westenburg ..... F42B 6/08 473/584
5,871,410 A * 2/1999 Simo ..... F42B 6/08 473/583
6,739,991 B1 * 5/2004 Wardropper ..... F42B 6/08 473/578
6,997,827 B1 * 2/2006 Grace, Jr. ..... F42B 6/08 473/583
7,160,217 B2 * 1/2007 Sohm ..... F42B 6/08 473/583
7,179,182 B2 * 2/2007 Summers ..... F42B 6/08 473/583
8,147,360 B2 * 4/2012 Simo ..... F42B 6/08 30/355

* cited by examiner

*Primary Examiner* — Alexander Niconovich
(74) *Attorney, Agent, or Firm* — Bennet K. Langlotz; Langlotz Patent & Trademark Works, Inc.

(57) ABSTRACT

A broad head arrowhead for easy attachment and removal to a configured receiving arrow shaft. The arrowhead body is of a monolithic molded configuration with an adapted mounting support extending for affixing to the end fitting receiving of an arrow shaft. The arrowhead of this invention is formed from synthetic resin material for structural rigidity and flight target penetration characters, having oppositely disposed tapered target engagement surface edges there along of a repetitive pattern.

6 Claims, 3 Drawing Sheets

DISPOSABLE BROAD HEAD ARROWHEAD

BACKGROUND OF THE INVENTION

1. Technical Field

This device relates to arrowheads, specifically hunting metal arrowheads that are subject to damage and loss during use.

2. Description of Prior Art

Prior art devices of this type have been directed to a variety of replaceable arrowheads that typically have a number of steel razor-sharp blades on a support frame. Such metal arrowheads are complex, heavy and costly to manufacture and assemble. Such arrowhead blades are by nature brittle and subject to breakage and damage during use and after use.

Improved integral one piece molded plastic arrowheads have been developed to replace the metal fabrications to date.

Examples of such plastic arrowheads can be seen U.S. Pat. Nos. 4,234,191 and 5,137,282.

U.S. Pat. No. 4,234,191 is directed to an archery arrowhead having a one-piece construction with a reinforced blade shape, having multiple blades with edge blade serrations to enhance performance.

U.S. Pat. No. 5,137,282 discloses a plastic molded or thermal shaped arrowhead with a primary attaching blade, utilizing interlocks to form wedging ridges along its respected cutting edges.

SUMMARY OF THE INVENTION

A synthetic resin molded broad head arrowhead of unitary one-piece integral construction with a pair of tapered primary penetrating edge blade surfaces on a central core. A longitudinally aligned mounting shaft extends for threaded engagement with a thread receiving end opening in an arrow shaft. The opposing blade edges are provided with unique repetitive scallop edge pattern for enhanced cutting and penetration within a viable cost-to-use loss ratio.

DESCRIPTION OF THE PREFERRED EMBODIMENT

Figure 1:
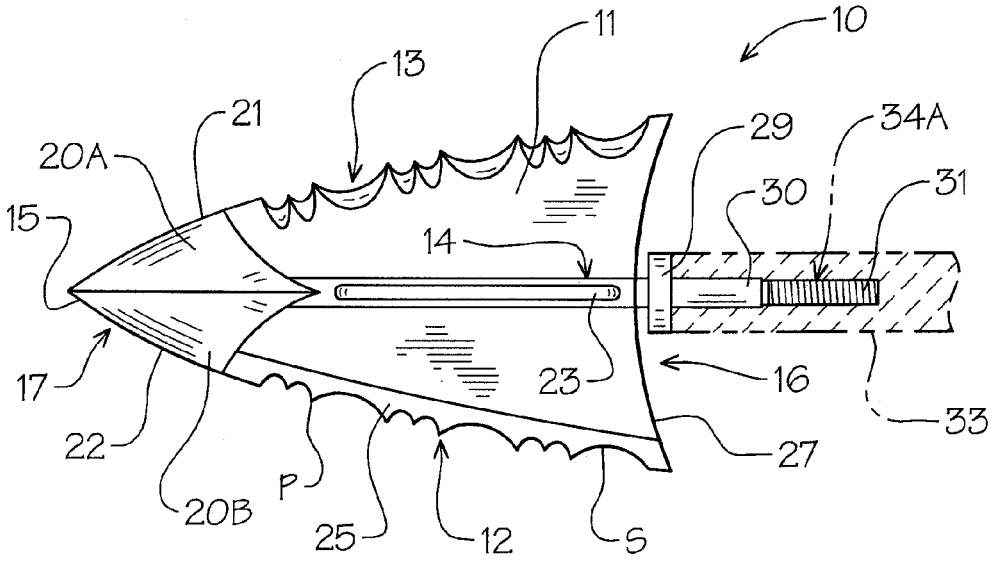
FIG. 1 is a top plan view of the improved broad head arrowhead.
Figure 2:
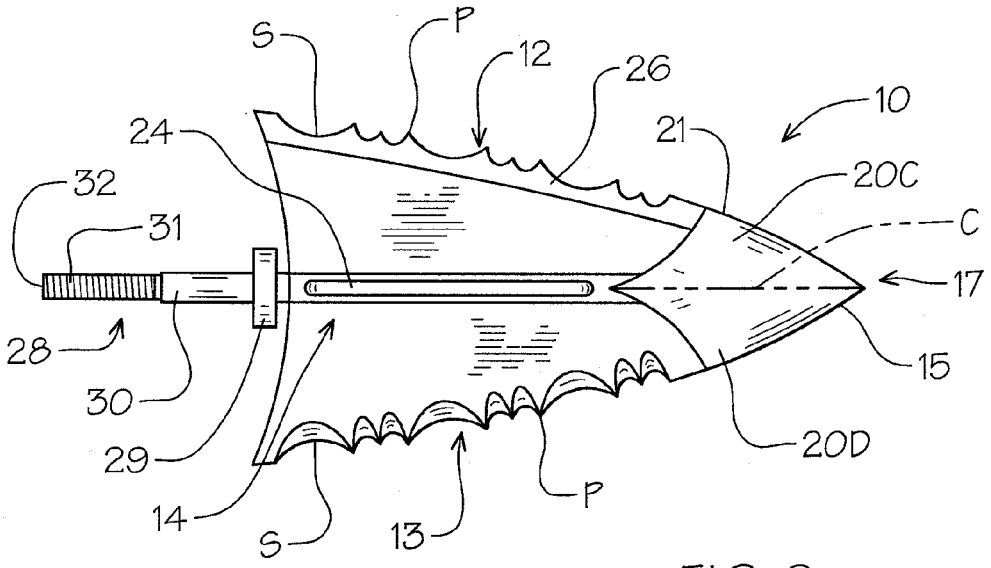
FIG. 2 is a bottom plan view thereof.

Referring to FIGS. 1 and 2 of the drawings, an improved broad head arrowhead 10 of the invention can be seen having a one-piece integral molded synthetic resin main body member 11, with oppositely disposed extending tapered blade edges 12,13 thereon. The main body 11 has a central longitudinal core portion 14 of increased annular dimension with an arrow end 15 an oppositely disposed base end 16.

The longitudinal axial core portion 14 is tapered along its dimension defining the transversally axially arrow end portion 15 and corresponding oppositely disposed wide mounting base end 16, thus defining a traditional 'arrow' head shape evident therein, and is well-known within the art.

An arrowhead end portion 17 is defined by oppositely disposed sharp and compound edges with tapered opposing surfaces 20A, 20B, 20C, 20D extending edge-wise from a central line C, defining a pair of solid edge surfaces 21,22 for initial penetrating contact, best seen in FIGS. 1 and 2 of the drawings.

Elongated recesses 23,24 are formed in the hereinbefore described axial core 14, forming a reinforced spine are for improved structural definition and target engagement performance, as will be understood by those skilled in the art.

Figure 6:
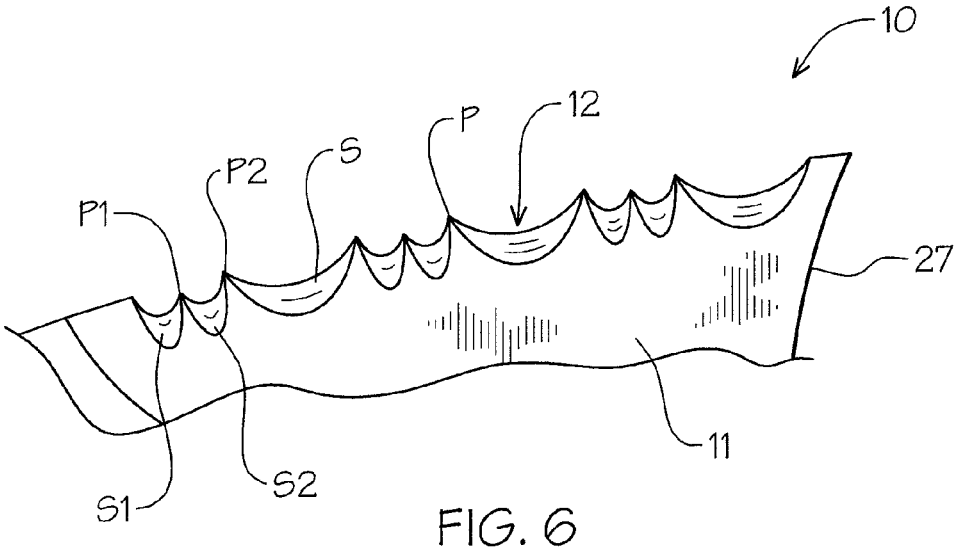
FIG. 6 is an enlarged partial top plan view of the arrow edge.

Referring now to the main body member 11, the oppositely disposed extending tapered blade edges 12,13 are of a progressive edge configuration having a distinctive repetitive edge pattern of scallops S and edge points P, best seen in FIG. 6 of the drawings.

Figure 3:
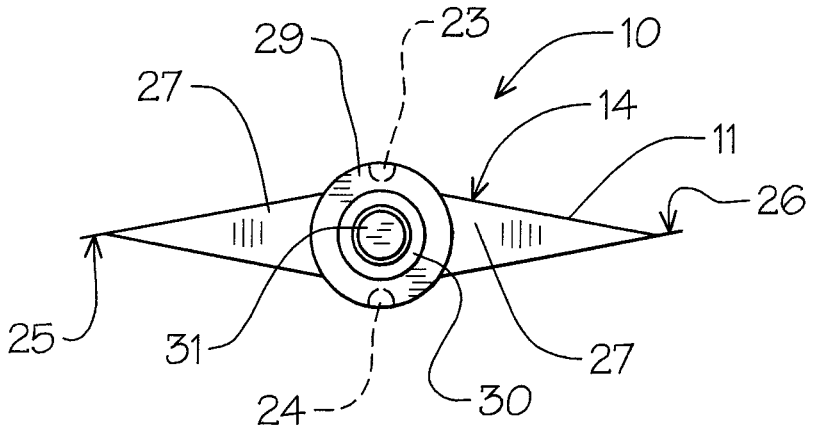
FIG. 3 is a right side end elevational view thereof.
Figure 4:
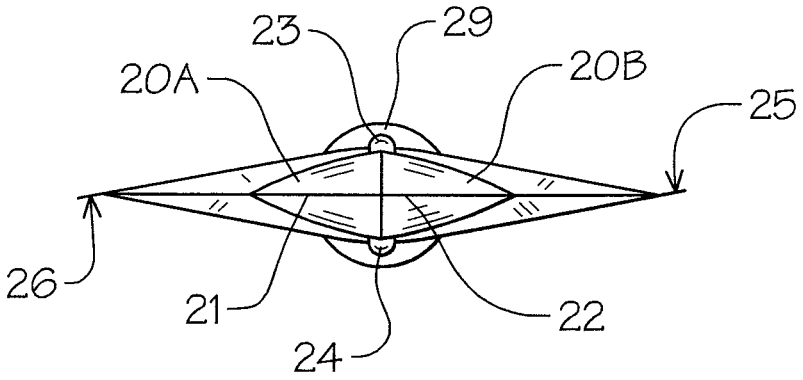
FIG. 4 is a left side end elevational view thereof.
Figure 5:
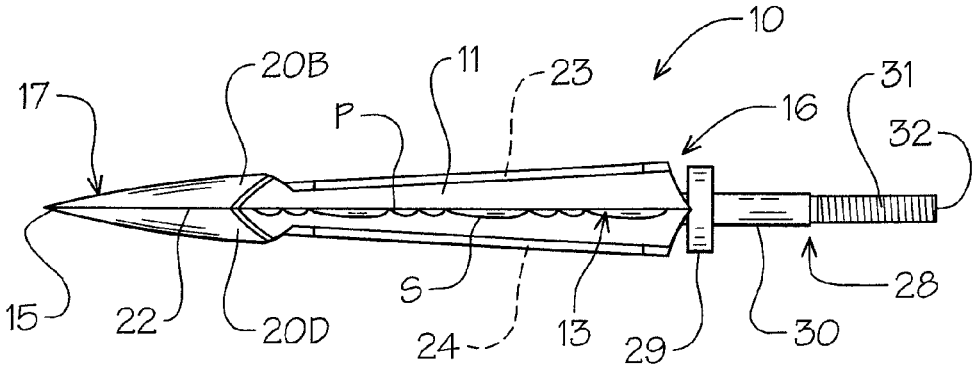
FIG. 5 is a front edge elevational view thereof; the rear being a mirror image.

The respective blade edge patterns are identical and formed along the respective edges, having an equivalent area of reduced dimensional thickness at 25,26, which in this instance is formed by molding, as best seen in FIG. 3 of the drawings. This molding technique replicates the honed edge surface found in transitional metal edged blades (not shown) and assures a razor-like cutting edge is achieved on the molded surface.

The unique edge pattern, as best seen in FIGS. 1 and 6 of the drawings, begins inwardly from the arrow end part 15 with a first point P1 formed between a pair of scalloped surfaces S1, S2. A second edge P2 is defined by the scallop S2 and a large scallop S3. It will be evident that the scallops S1, S2, S3 therefore define an edge pattern that repeats longitudinally along the respective tapered blade edges 12,13. As noted, the blade edges 12,13 have respective molded "honed" areas 25,26 are in oppositely disposed surface orientation on the main body 11, extending along their respective blade edges 12,13 with their repetitive multiple point and scallop pattern, as herein and before described.

The arrowhead base end 16 as noted, defines a transversally wide bottom area with a concaved end surface 27 there along. A center line blade mounting extension shaft 28 extends integrally therefrom with an annular transition fitting 29 of increased annular dimension is in space relation to the base end 16 of the main body member 11.

An integral shaft 30 extends from the transition fitting 29 having a threaded end portion 31 extending to its free end at 32.

The threaded end shaft portion 31 is therefore adapted to thread-secure the arrowhead 10 to an arrowhead shaft 33, shown in broken lines in FIG. 2 of the drawings with a corresponding threaded receiving socket 34A formed there within.

This structural orientation will provide inter-changeability and replacement of the arrowhead 10 when required during use or when lost or damaged, as will be understood by those skilled in the art.

Therefore, it will be evident based on the above description that the improved broad head arrowhead 10 of the invention provides a unique one-piece integral monolithic molded synthetic resin broad head arrowhead configuration with unique integral tapered blade edges 12,13, utilizing a combination of repetitive pattern of scallop edged point formation along a longitudinal area of reduced edge surface dimension to emulate a honed metal surface.

It will thus be seen that a new and novel one piece molded synthetic resin broad head arrowhead 10 of the invention has been illustrated and described, and will be apparent to those skilled in the art that various changes and modifications may be made thereto without departing from the spirit of the invention.

Therefore, I claim:

1. An improved plastic hunting arrowhead comprising, a molded one-piece body having elongated central axis core of increased annular dimension, oppositely disposed longitudinally and transversely tapered blade portions extending therefrom, said one-piece body having a front end terminating at a sharp point and an oppositely disposed transversely concaved end surface of dimension greater than that of said front end and an axial core extension of reduced annular diameter, a portion of which adapted to be received within an arrow shaft, blade edges on opposite opposing convex molded hone surfaces of said respective tapered blade portions, said blade edges comprises multiple sets of blade points and blade scallops in repetitive side-by-side longitudinal space curvilinear pattern orientation.

2. The arrowhead set forth in claim 1 wherein said central axis core has oppositely disposed elongated recesses along its respective length and an arrowhead mounting extension shaft, an annular transition fixture on said shaft in spaced relation to said transversely concaved end surface of said one-piece body.

3. The arrowhead set forth in claim 2 wherein said axial core extension further comprises, a threaded end shaft.

4. The arrowhead set forth in claim 1 wherein said arrowhead body front end comprises, sharpened compound edges on respective pairs of oppositely disposed opposing contoured tapered surfaces terminating at said sharp point of said one-piece body.

5. The arrowhead set forth in claim 1 wherein said repetitive pattern of said multiple sets of blade edge points and said blade scallops on opposite opposing convex molded hone surfaces comprises, a first pair of surface scallops of a known equal dimension, an upstanding blade point between said first pair of surface scallops, a single surface scallop of a dimension greater than that of said first pair of surface scallops known dimension, an upstanding blade point there between.

6. The arrowhead set forth in claim 1 wherein said arrowhead body is of a high impact resistant molded synthetic resin having a smooth exterior surface.

* * * * *